US005307618A

United States Patent [19]

Livesay et al.

[11] Patent Number: 5,307,618

[45] Date of Patent: May 3, 1994

[54] INDEXING APPARATUS FOR A TRACK PRESS

[75] Inventors: Richard E. Livesay, Peoria, Ill.; Owen R. Thompson, Louisville, Ky.

[73] Assignee: Caterpillar Inc., Peoria, Ill.

[21] Appl. No.: 33,725

[22] Filed: Mar. 18, 1993

[51] Int. Cl.[5] ..... B21L 21/00

[52] U.S. Cl. ..... 59/7; 59/901

[58] Field of Search ..... 59/7, 8, 10, 11, 35.1, 59/901

[56] References Cited

U.S. PATENT DOCUMENTS

| | | | |
|---|---|---|---|
| 3,075,346 | 1/1963 | Quarve et al. | 59/7 |
| 3,126,938 | 3/1964 | McCoy | 153/48 |
| 3,339,706 | 9/1967 | Arvidson | 198/34 |
| 4,027,471 | 6/1977 | Lipp et al. | 59/7 |
| 4,135,360 | 1/1979 | Morley | 59/7 |
| 4,881,365 | 11/1989 | Moriki et al. | 59/7 |
| 5,197,273 | 3/1993 | Livesay et al. | 59/7 |
| 5,214,907 | 6/1993 | Livesay et al. | 59/7 |
| 5,214,908 | 6/1993 | Livesay et al. | 59/7 |
| 5,214,909 | 6/1993 | Livesay et al. | 59/7 |

*Primary Examiner*—David Jones

*Attorney, Agent, or Firm*—Claude F. White

[57] ABSTRACT

An indexing apparatus for a track press machine moves and positions a track chain assembly into and out of the work area of the track press machine. The indexing apparatus includes upper and lower indexing portions, each having a powered drive mechanism for contacting and driving the track chain assembly. Fluid operated cylinders apply a force between the drive mechanisms and the track chain to prevent slippage. Fluid motors power the drive mechanisms to positively and continuously move the track chain. The indexing cycle is automatically controlled for fast and consistent work operations.

13 Claims, 7 Drawing Sheets

INDEXING APPARATUS FOR A TRACK PRESS

TECHNICAL FIELD

This invention relates generally to an indexing apparatus and more particularly to a powered indexing apparatus which moves endless track chain assemblies into and out of a work area of a track press machine.

BACKGROUND ART

Assembling and dis-assembling the components of endless track chains are often difficult, time consuming, and noisy tasks. The track press machines used for these tasks are generally quite large, are difficult to operate and are generally slow in performing the repetitive work functions. Because the track chains are heavy and cumbersome, it is difficult to move them into and out of the work area of the track press machine. Precisely indexing the heavy track chains in the work area is also very difficult.

One type of machine for performing the dis-assembly and re-assembly operations on endless track claims is disclosed in U.S. Pat. No. 3,075,346, issued Jan. 29, 1963, to V. K. Quarve et al. In this patent, the endless track chain is moved in and out of the work area by a plurality of metal conveyor rollers. All of these rollers are connected at corresponding ends by sprockets and chains for rotation in unison. The sprockets and chains are powered by an air motor through a manually controllable clutch. The air motor also drives a winch for pulling the track chain onto the conveyor. This mechanism for indexing the track chain into and out of the work area is complex and requires a large number of sprockets and chains. Additionally, although the conveyor rollers are powered, slippage between the metal rollers and the metal track could take place if oil and other debris is spilled onto the rollers or track chain.

The present invention is directed to overcoming one or more of the problems as set forth above.

DISCLOSURE OF THE INVENTION

In one aspect of the present invention, an indexing apparatus for moving and positioning a track chain assembly into and out of the work area of a track press machine includes first and second lower and upper indexing portions respectively, each indexing portion having a rotatable means for moving the track chain assembly, first and second power means for driving the rotatable means, and first and second fluid cylinders for moving the lower and upper indexing portions toward each other.

In another aspect of the present invention, an indexing apparatus for a track press includes an automatic control system for automatically sequentially operating a plurality of fluid motors and fluid cylinders for moving a track chain assembly into and out of the work area of the track press.

Most prior art track presses for assembling and disassembling track assemblies use manually operated indexing apparatus. These apparatus are generally considered either positive but discontinuous, or are continuous but not positive. One prior art indexer use pawls or fingers which reach between the track assemblies to contact the track bushings and move the track. Because these pawls are not continuous, the track moves in short jerks with periods of non-movement between the jerks. Another prior art indexer uses power driven metal rollers. These driven rollers become covered with oil and other debris which causes slippage between the rollers and the track.

The subject invention provides an indexing apparatus which is positive and continuous and which is automatically controlled to ensure exact and repeatable movement of the track during each cycle.

BEST MODE FOR CARRYING OUT THE INVENTION

Figure 1:
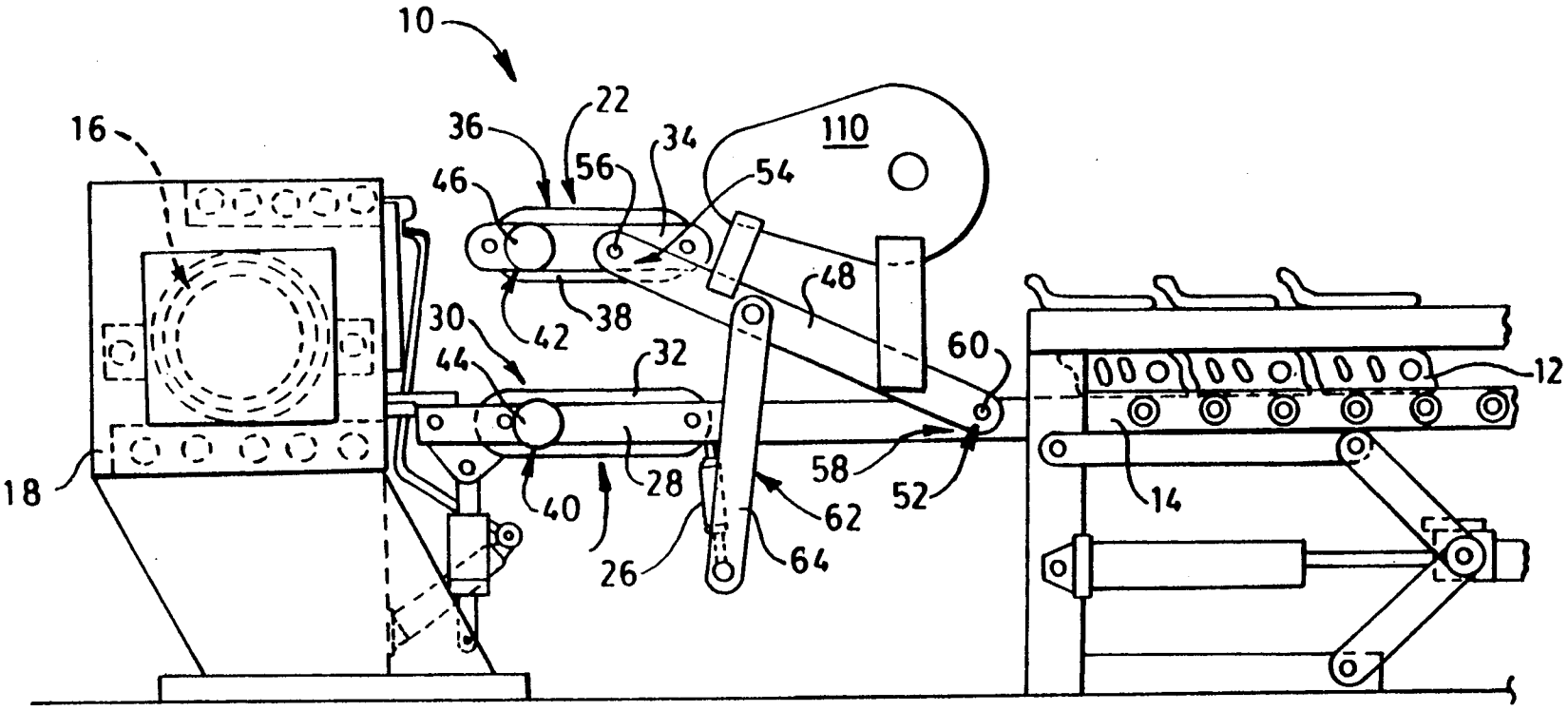
FIG. 1 is a diagrammatic side elevational view of a track press machine including the subject indexing apparatus.

Referring to the drawings, an indexing apparatus 10 for moving a track chain assembly 12 off of or onto a support structure 14 and for positioning the track chain assembly 12 into and out of the work area 16 of a track press machine 18 includes first and second lower and upper indexing portions 20,22, and first and second fluid cylinders 24,26 connected respectively to the first and second lower and upper indexing portions 20,22. The first lower indexing portion 20 has a lower frame structure 28 and a first rotatable means 30 for moving the track chain assembly 12. The first rotatable means 30 includes a first endless flexible drive belt 32 which is mounted within the lower frame structure 28. The second upper indexing portion 22 is similar to the first lower indexing portion 20 and includes an upper frame structure 34 and a second rotatable means 36 for moving the track assembly 12. The second rotatable means 36 includes a second endless flexible drive belt 38 which is mounted within the upper frame structure 34.

The indexing apparatus 10 further includes first and second power means 40,42 which are adapted to drive the first and second rotatable means 30,36, respectively. The first fluid cylinder 24 is adapted to move the first lower indexing portion 20 between a first lower position and a second upper position, and the second fluid cylinder 26 is adapted to move the second upper indexing portion 22 toward the first lower indexing portion 20. Whenever the first fluid cylinder 24 raises the lower indexing portion 20, the track chain assembly 12 which is positioned within the work area 16 of the track press machine 18 is also raised by the first and second extension bars 41,43. The first and second power means 40,42 include first and second reversible fluid drive motors 44,46 which are adapted to rotate the first and second endless drive belts 32,38, respectively. Preferably, the first and second drive motors 44,46 are supplied with fluid power from a single common fluid supply line. This avoids any problems of locking up either of the endless drive belts 32,38 whenever the first and second indexing portions are engaged with the track chain assembly 12.

Figure 3:
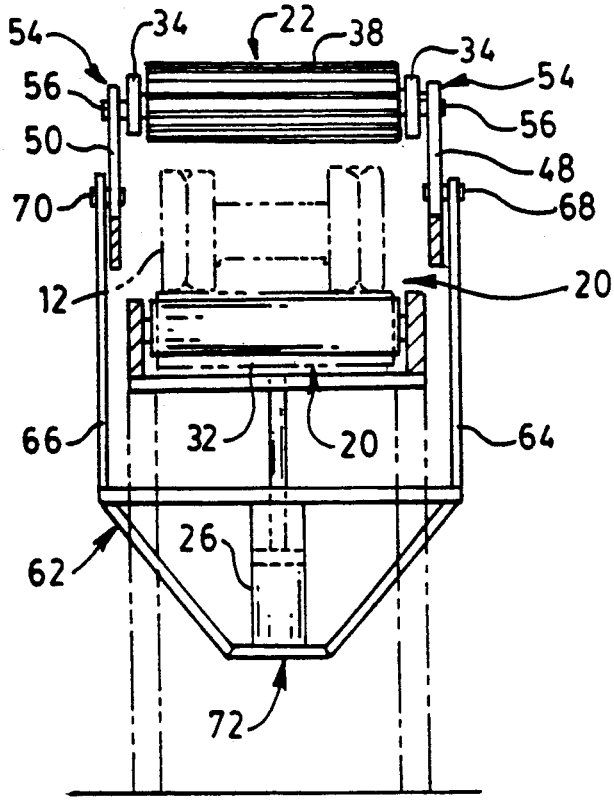
FIG. 3 is a diagrammatic view, partially in section, taken generally along the lines 3—3 of FIG. 1.

With particular reference to FIGS. 1 and 3, first and second support arms 48,50 connect the upper indexing portion 22 to the support structure 14. Each support arm 48,50 has a first end portion 52 pivotably connected to the support 14, and a second end portion 54 pivotably connected to the upper frame structure 34. The upper frame structure 34 is pivotably mounted to the second end portions 54 of the first and second support arms 48,50 by a first pivot pin 56 so it can rotate about the pivot pin 56 and adjust to any variations in the surface of the track chain assembly 12. The lower frame structure 28 has a first end portion 5 which is pivotably connected to the support structure 14 by a second pivot pin 60. Preferably, the second pivot pin 60 can also mount the first and second support arms 48,50 to the support structure 14. A bracket assembly 62 has first and second spaced connecting arms 64,66 which straddle the lower indexing portion 20 and pivotably connect to the first and second support arms 48,50, respectively, by third and fourth pivot pins 68,70. The bracket assembly 62 includes a mounting portion 72 and the second fluid cylinder 26 is connected between the mounting portion 72 and the lower frame structure.

Figure 5:
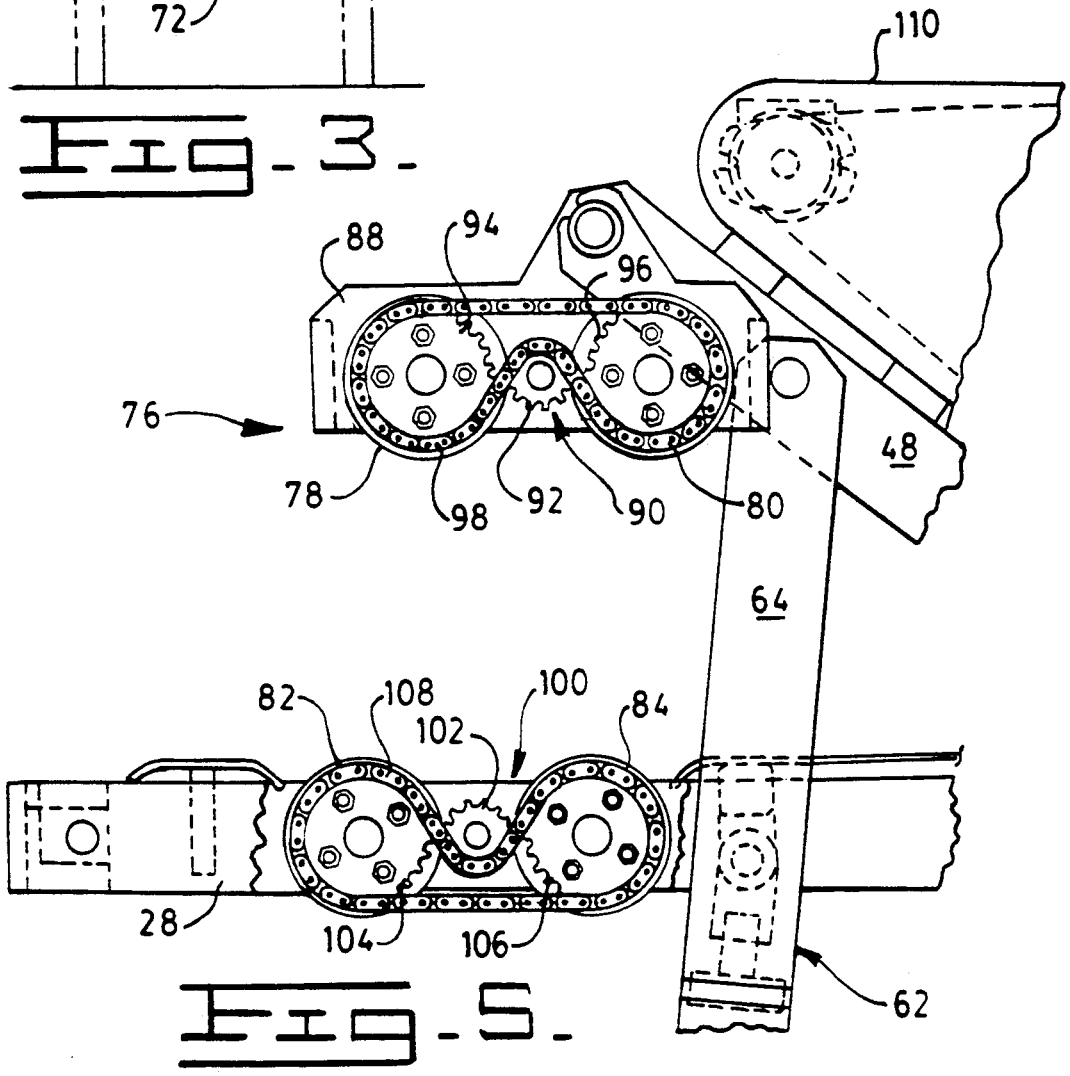
FIG. 5 is an enlarged side elevational view of a portion of the indexing apparatus of FIG. 5, with the motors, and side plates removed.
Figure 4:
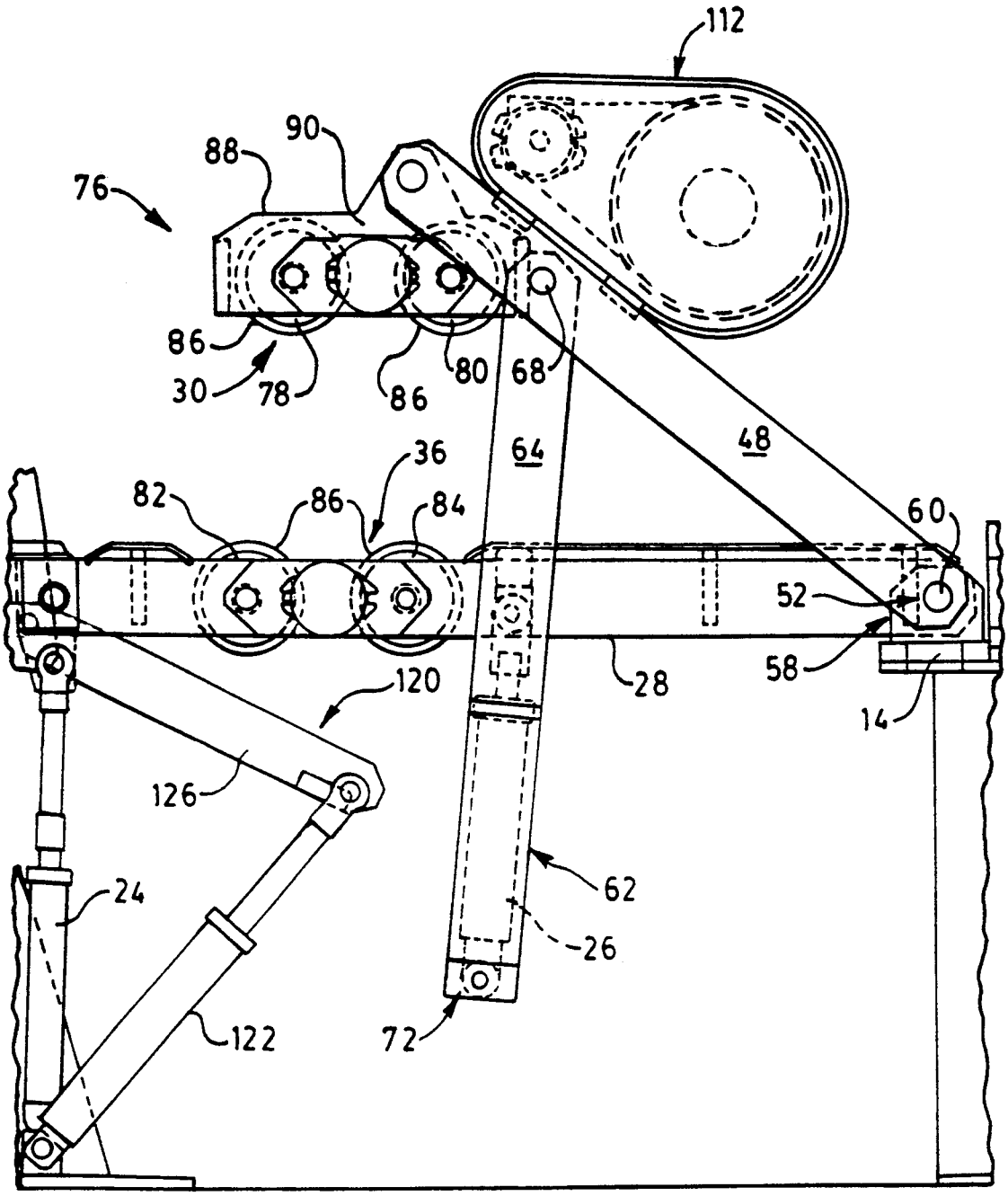
FIG. 4 is an enlarged diagrammatic side elevational view of a second embodiment of an indexing apparatus.
Figure 6:
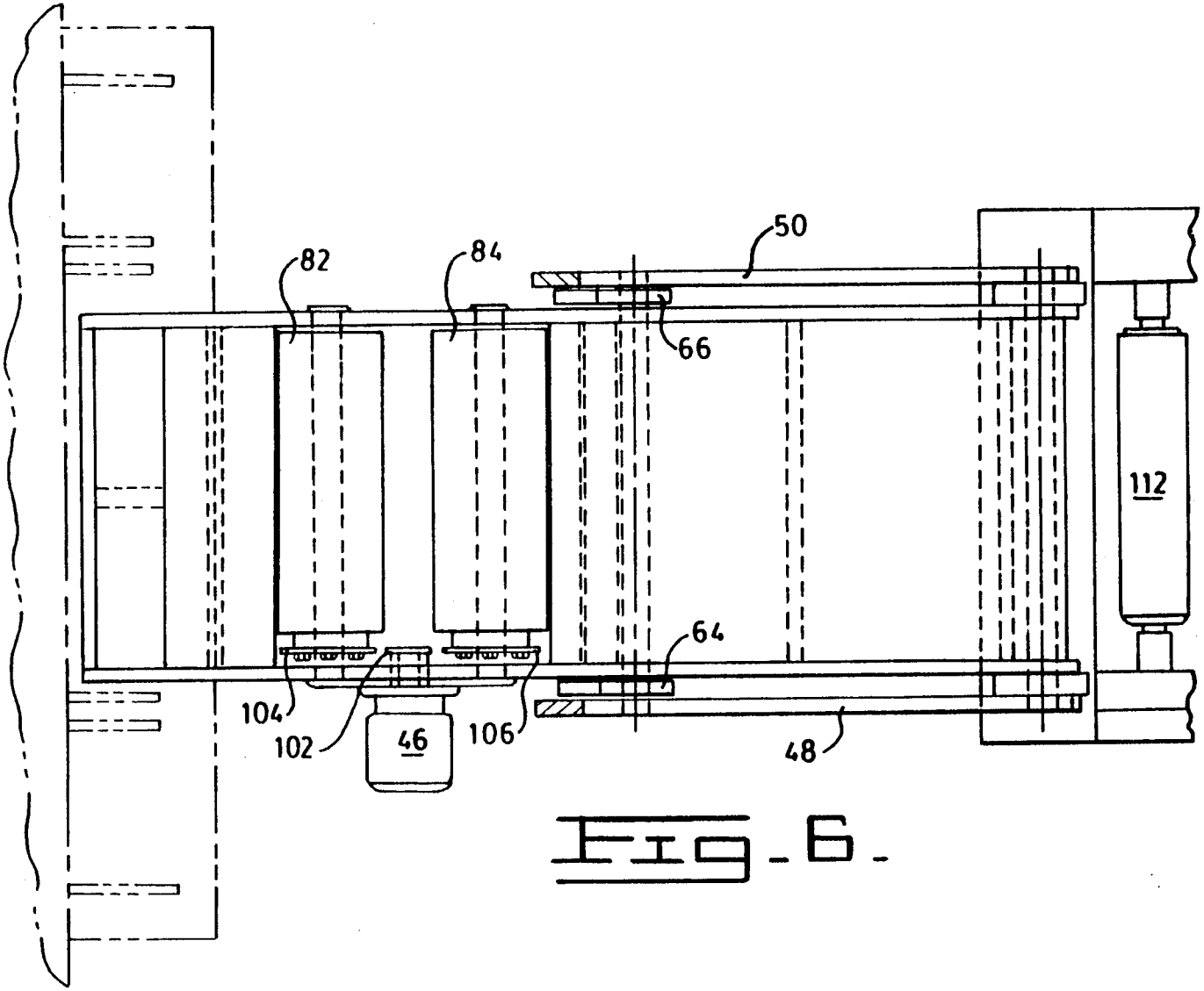
FIG. 6 is an enlarged plan view taken generally along the lines 6—6 of FIG. 4.

With particular reference to FIGS. 4, 5, and 6, a second embodiment of an indexing apparatus 76 is illustrated. In this embodiment, many of the components previously described, with reference to the first indexing apparatus 10, are common and will be designated by like reference numerals. The indexing apparatus 76 includes first and second cylindrical drive rollers 78,80 for the first rotatable means 30, and third and fourth cylindrical drive rollers 82,84, for the second rotatable means 36. Each of the drive rollers 78,80,82,84 has an exterior cylindrical surface 86 which is covered with rubber or other resilient material. The first and second drive rollers 78,80 are mounted in an upper frame structure 88 to define a space 90 therebetween. The first fluid drive motor 44 is mounted to the frame structure 88 and positioned in the space 90. The first drive motor 44 includes a first drive sprocket 92 which is connected to first and second roller sprockets 94,96 by a first drive chain 98 to drive the first and second drive rollers 78,80, the first and second roller sprockets 94,96 are connected respectively to the first and second drive rollers 78,80.

In a similar manner, the third and fourth drive rollers are mounted in the lower frame structure 28 to define a space 100 therebetween. The second fluid drive motor 46 is mounted to the frame structure 28 and positioned in the space 100. The second drive motor 46 includes a second drive sprocket 102 which is connected to third and fourth roller sprockets 104,106 by a second chain 108 to drive the third and fourth drive rollers 82,84. The third and fourth roller sprockets are connected respectively to the third and fourth drive rollers 82,84.

A winch assembly 110 is mounted to the first and second support arms 48,50 and serves to pull the track chain assembly 12 along the support structure 14 and into the indexing apparatus 10. A plurality of conveyor rollers 112 are mounted within the support structure 14 and assist in moving the track chain assembly 12.

Figure 2:
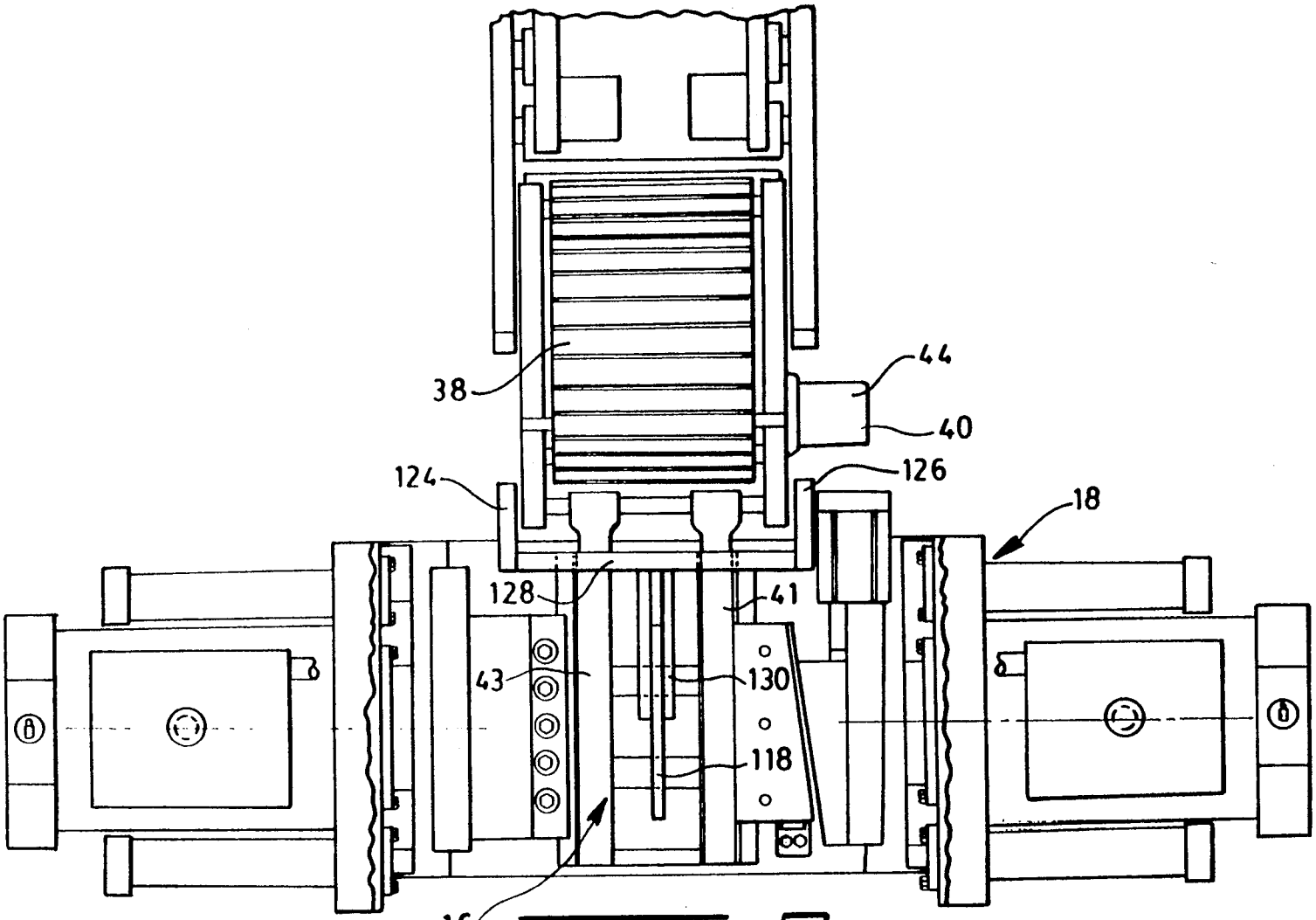
FIG. 2 is an enlarged diagrammatic plan view of a portion of the track press machine and indexing apparatus taken generally along the lines 2—2 of FIG. 1.
Figure 7:
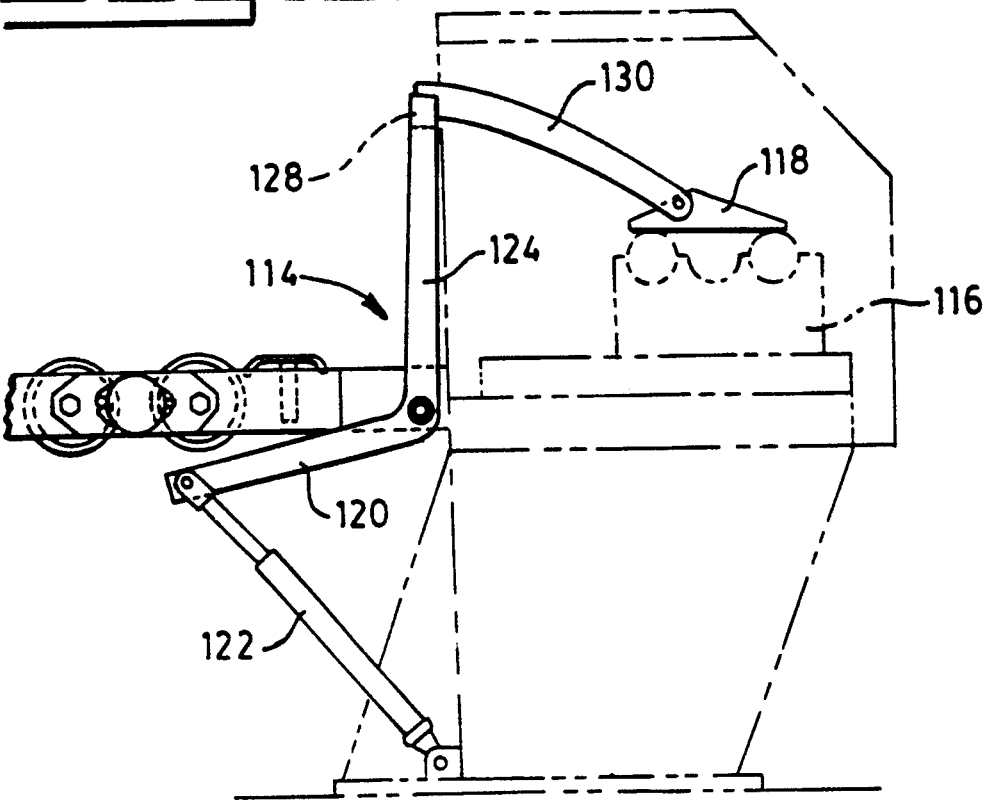
FIG. 7 is a diagrammatic side elevational view of a portion of the subject indexing apparatus and a hold down clamping bar.

With particular reference to FIGS. 2, 4, and 7, the track press machine 18 includes a hold down clamping mechanism 114 which serves to push the track chain assembly 12 into a tool fixture 116 and hold the track chain assembly 12 while it is worked on by the track press machine 18. The clamping mechanism 114 includes a hold-down bar 118, a pivotable linkage assembly 120, and a third fluid cylinder 122 for pivoting the linkage assembly 120 between first and second positions. The linkage assembly 120 has first and second parallel side arms 124,126, a cross beam 128, and a central arm 130 which connects the hold-down bar 118 to the cross beam 128.

Figure 8:
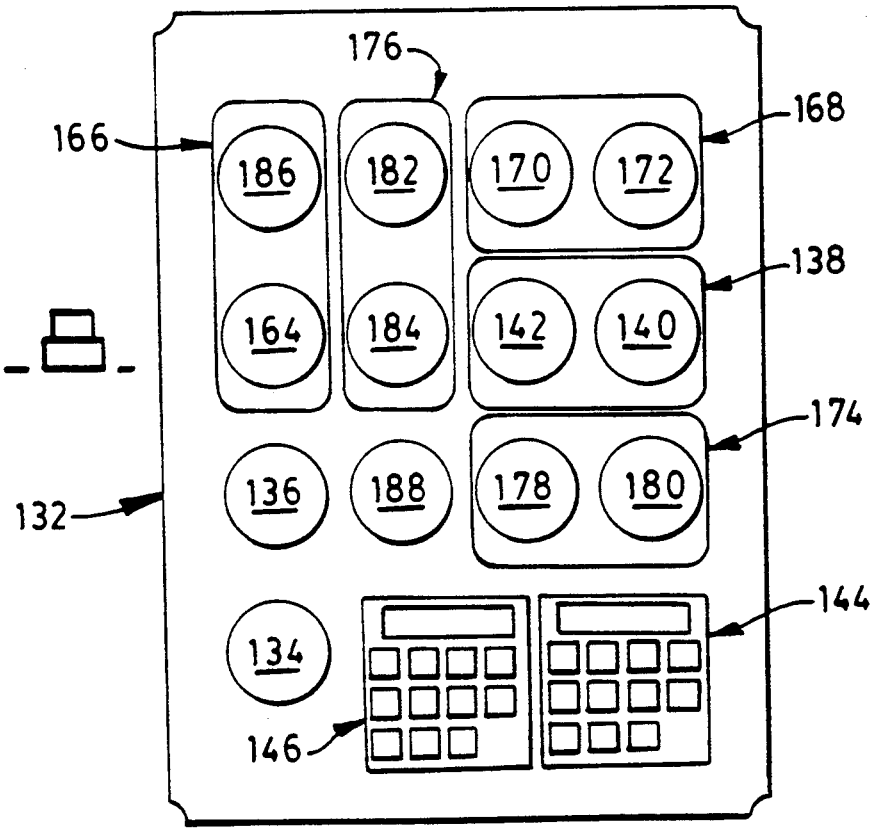
FIG. 8 is a diagrammatic front elevational view of a control panel for use with the subject indexing apparatus.
Figure 9:
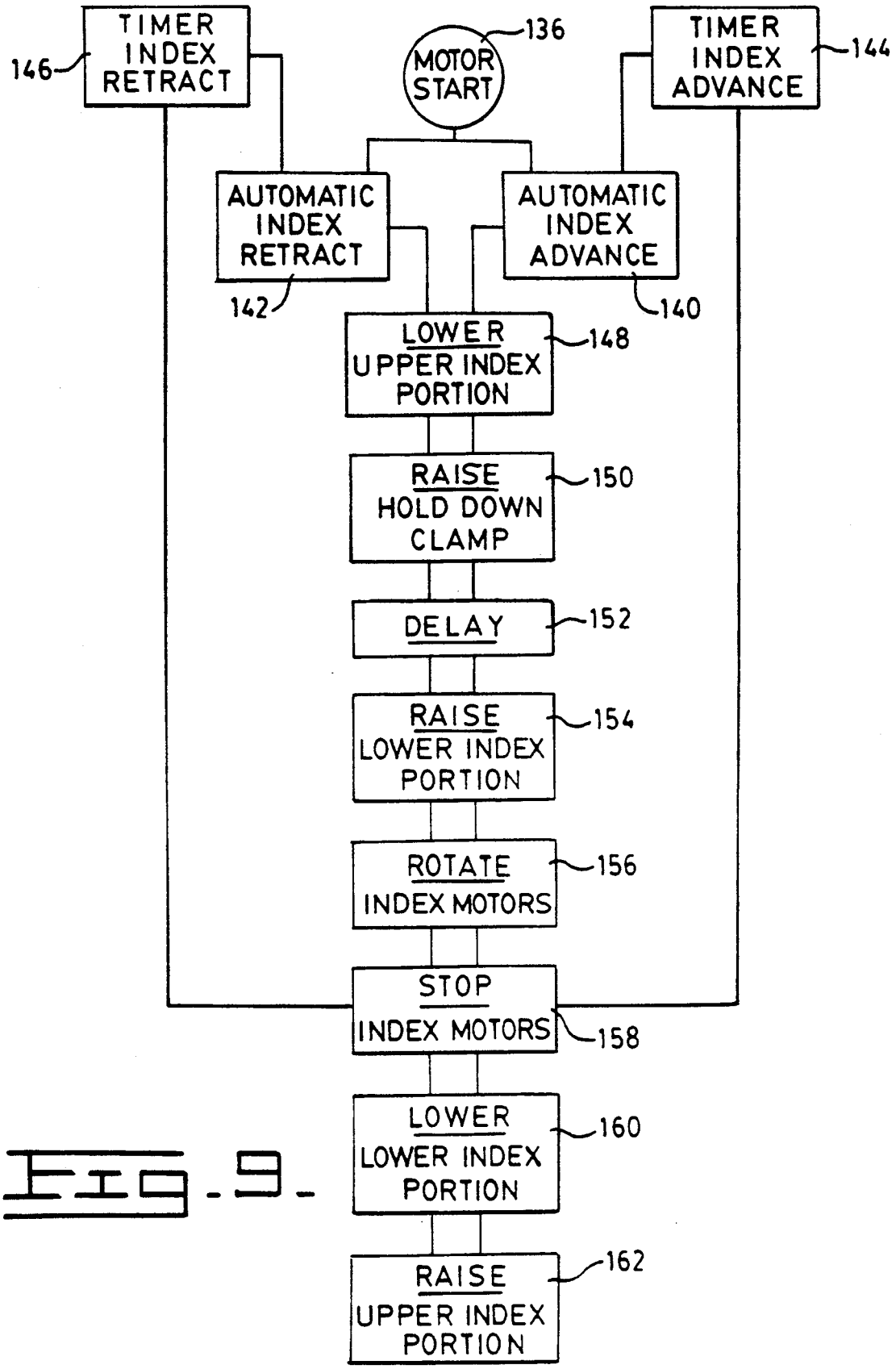
FIG. 9 is a diagrammatic flow chart of the sequence of operations of the automatic indexing mode of the present invention.

With reference to FIGS. 8 and 9, the subject indexing apparatus 10 is advantageously operated by an automatic control system, the operation of which is represented by the flow chart shown in FIG. 9. FIG. 8 illustrates a control panel 132 which controls the various operating functions of the indexing apparatus 10, including the automatic indexing feature. To begin an automatic operation, the main power control button 134 must be pulled on, as indicated on the control panel 132. The motor button 136 is then activated to start the electrical motor and fluid pumps (not shown). The automatic indexing cycle is then selected from the control block 138 by activating the advance switch 140 or the retract switch 142. The advance mode is used in disassembling a track chain assembly 12, and the retract mode is used in the assembly of a track chain assembly 12. However, prior to starting the automatic cycle, the index advance timer 144 or the index retract timer 146 must be set to preselect the cycle time. The rate of movement of the various track pitches and track types has been converted into times in seconds for advance and retract during the assembly/disassembly operation. Signs or decals, indicating these times, are preferably attached to the track press machine 18. The machine operator refers to the decal (not shown) and sets the timer for the designated time.

Assuming a dis-assembly operation, the operator sets the timer 144 and activates the advanced switch 140. The automatic cycle then progresses, as indicated by the flow chart shown in FIG. 9. The upper indexing portion 22 is lowered against the track assembly 12, represented by the box 148, and the hold down clamping mechanism 114 is then raised, represented by the box 150. A short delay occurs, represented by the box 152, before the lower indexing portion 20 is raised, represented by the box 154. The indexing motors 44,46 are then rotated, shown by the box 156, and are stopped after the pre-set time, shown by the box 158. The lower indexing portion 20 is then lowered, shown by the box 160, and the upper indexing portion 22 is raised, shown by the box 162. This ends the automatic indexing cycle. Of course, a portion of the track chain assembly 12 has been moved into the work area 16 by the indexing apparatus 10 and is lowered into the tool fixture 116 when the lower indexing portion 20 is lowered. An assembly operation is substantially similar, with the start of the automatic cycle beginning with activation of the automatic retract switch. Following either the automatic advance or retract cycle, the hold down clamping mechanism 114 is lowered against the track chain assembly manually by activating the down switch 164 on the hold down shoe block 166.

The control panel 132 includes a plurality of other manually operable control blocks, including a manual index block 168, having a retract switch 170 and an advanced switch 172, an indexer drive block 174, and an indexer lift block 176. The indexer drive block 174 includes an engage switch 178 and a disengage switch 180, and the indexer lift control block 176 includes an indexer up switch 182 and an indexer down switch 184. Additional control switches on the control panel 132 include a hold down shoe up switch 186, and an assemble/disassemble switch 188.

Industrial Applicability

With reference to the drawings, the subject indexing apparatus 10 is particularly useful for moving and positioning track chain assemblies 12 into and out of the work area 16 of a track press machine 18. The track chain assembly 12 is initially pulled onto the support structure 14 and into the indexing apparatus 10 by the winch assembly 110. The indexing apparatus 10 then moves the track chain assembly 12 into the work area 16 where it is positioned in the tool fixture 116, where it can be worked on by the track press machine 18. The indexing apparatus 10 can be operated manually by the various switches on the control panel 132, or preferably by the automatic cycle, also operated from the control panel 132. The various steps of the automatic cycle were previously described with reference to the control panel 132 shown in FIG. 8, and the flow chart shown in FIG. 9.

Other aspects, objects and advantages of this invention can be obtained from a study of the drawings, the disclosure, and the appended claims.

We claim:

1. An indexing apparatus for moving a track chain assembly off of and onto a support structure and for positioning the track chain assembly into and out of a work area of a track press, comprising;

a first lower indexing portion having a lower frame structure and first rotatable means for moving said track chain assembly, said first rotatable means being mounted within said lower frame structure;

a second upper indexing portion having an upper frame structure and second rotatable means for moving said track chain assembly, said second rotatable means being mounted within said upper frame structure;

first and second power means for driving said first and second rotatable means respectively;

a first fluid cylinder connected to said first lower indexing portion and adapted to move said first lower indexing portion between a first lower position and a second upper position; and a second fluid cylinder connected to said second upper indexing portion and adapted to move said second upper indexing portion toward said first lower indexing portion.

2. An indexing apparatus, as set forth in claim 1, wherein said first and second rotatable means includes respective first and second endless drive belts.

3. An indexing apparatus, as set forth in claim 2, wherein said first and second power means 38,40 includes first and second reversible drive motors connected to and adapted to drive each endless drive belt respectively.

4. An indexing apparatus, as set forth in claim 1, wherein each of said first and second rotatable means includes first and second cylindrical drive rollers.

5. An indexing apparatus, as set forth in claim 4, wherein each drive roller has an exterior cylindrical surface and including a resilient material secured to and covering said exterior surface.

6. An indexing apparatus, as set forth in claim 4, wherein said first and second drive rollers define a space therebetween, and including a drive motor positioned in said space and connected to said drive rollers.

7. An indexing apparatus, as set forth in claim 1, wherein said first rotatable means includes a first fluid powered motor and said second rotatable means includes a second fluid powered motor, said first and second motors being supplied with fluid power from a single common fluid supply line.

8. An indexing apparatus, as set forth in claim 1, including first and second support arms, each support arm having first and second end portions, said first end portions being pivotably connected to said support structure and said second end portions being pivotably connected to said upper frame structure.

9. An indexing apparatus, as set forth in claim 8, wherein each upper frame structure is pivotably connected to said second end portions of said first and second support arms.

10. An indexing apparatus, as set forth in claim 1, wherein said lower frame structure has a first end portion, said first end portion being pivotably connected to said support structure.

11. An indexing apparatus, as set forth in claim 8, including a bracket assembly having first and second spaced connecting arms, said first and second connecting arms being pivotably connected to said first and second support arms respectively.

12. An indexing apparatus, as set forth in claim 11, wherein said bracket assembly includes a mounting portion, said second fluid cylinder being connected between said mounting portion and said lower frame structure.

13. An indexing apparatus of a track press, said indexing apparatus having upper and lower indexing portions and an automatic control system, comprising;

a power control panel having a plurality of control switches;

a plurality of fluid motors connected to said indexing apparatus;

an automatic indexing control having an advance switch and a retract switch;

an adjustable indexing advance timer adapted to control the duration of power suppliable to said plurality of fluid motors in a first mode of operation;

an adjustable indexing retract timer adapted to control the duration of power suppliable to said plurality of fluid motors in a second mode of operation;

a first fluid cylinder having a first end portion and connected to said lower indexing portion and adapted to move said lower portion between first and second positions;

a second fluid cylinder having first and second end portions and connected to said upper indexing portion and adapted to move said upper portion between first and second positions;

a hold down clamping mechanism;

a third fluid cylinder having first and second end portions and connected to said hold down clamping mechanism and adapted to move said clamping mechanism between first and second portions;

means for sequentially supplying power to the first end portions of said first, second, and third fluid cylinders and then to said fluid motors;

means for sequentially discontinuing power to said fluid motors and then to the first end portions of said first, second, and third fluid cylinders; and means for supplying fluid power to said second end portion of said third fluid cylinder.

* * * * *